United States Patent [19]

Levitt

[11] Patent Number: 4,918,822

[45] Date of Patent: Apr. 24, 1990

[54] PERSPECTIVE DRAFTING APPARATUS

[76] Inventor: Semond Levitt, 1835 Lippincott Rd., Huntingdon Valley, Pa. 19006

[21] Appl. No.: 351,790

[22] Filed: May 15, 1989

[51] Int. Cl.[5] ..... B43L 13/14

[52] U.S. Cl. ..... 33/432; 33/1 K

[58] Field of Search ..... 33/432, 434, 18.3, 1 K, 33/433

[56] References Cited

U.S. PATENT DOCUMENTS

| | | | |
|---|---|---|---|
| 2,556,620 | 6/1951 | Hegner | 33/432 |
| 2,669,025 | 2/1954 | Hysing | 33/432 |
| 2,714,253 | 8/1955 | Stone | 33/183 |
| 2,998,654 | 9/1961 | Hancox | 33/432 |
| 3,258,843 | 7/1966 | Nosser | 33/432 |
| 3,826,007 | 7/1974 | Senshu et al. | 33/432 |
| 4,166,322 | 9/1979 | Hirano | 33/432 |
| 4,254,555 | 3/1981 | Julian | 33/434 |
| 4,360,975 | 11/1982 | Wurtz | 33/432 |
| 4,403,423 | 9/1983 | Ford et al. | 33/432 |
| 4,453,318 | 6/1984 | Hayes | 33/432 |

OTHER PUBLICATIONS

Calibron Notebook, Edison, May 1936, pp. 16–21.

*Primary Examiner*—William A. Cuchlinski, Jr.
*Assistant Examiner*—Christopher W. Fulton
*Attorney, Agent, or Firm*—Walter B. Udell

[57] ABSTRACT

A perspective drafting device including a pair of straight edges pivotally connected to a centerpiece removably fixable to the horizontal arm of a drafting machine in place of the horizontal scale. Each of the straight edges is slidable through a vanishing point guide which latter is provided with a pin on its bottom surface extending substantially orthogonally to the drafting table and projectable downwardly for pivotal seating movement within a selected one of a number of holes provided in the surface of the drafting board at the left and right margins in rows spaced vertically along the drafting board. The vertical spacing of the holes selects the particular horizon desired, whereas the horizontal spacing of the holes provides horizontal rotation of the perspective view as desired. The centerpiece of the perspective device to which the straight edges are affixed is provided with a hole through which a vertical pin extending upward from the bottom edge of the table may be disposed, such hole being positioned in the centerpiece so that the center of the hole is in vertical alignment with the left-hand and/or right-hand edges of the vertical scale of the drafting machine. When the hole in the centerpiece is projected onto the fixed pin, the pin acts as a pivot so that movement of the drafting machine control knob permits pivoting rotation of the vertical scale to the left and to the right so that lines may be established from significant parts of the drawing from which it is desired to make the perspective view.

11 Claims, 7 Drawing Sheets

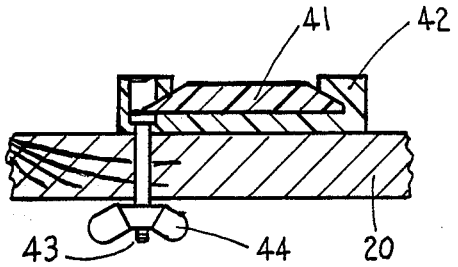
FIG. 3
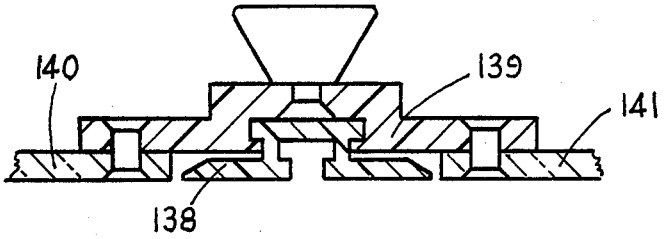
FIG. 9
FIG. 10
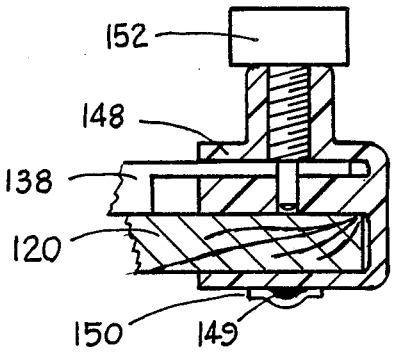
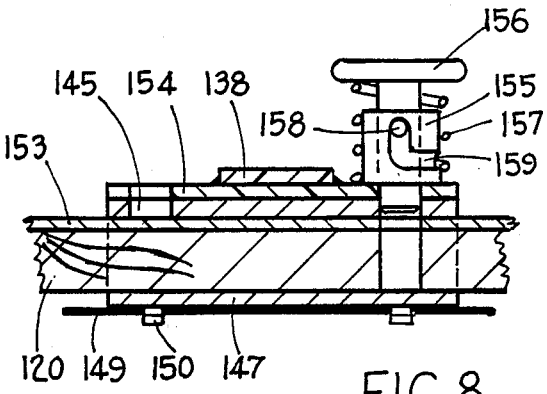
FIG. 8
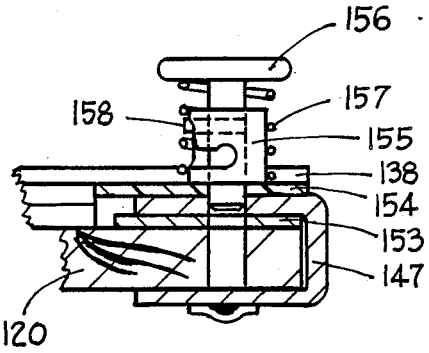
FIG. 7

PERSPECTIVE DRAFTING APPARATUS

This invention relates generally to perspective drafting devices, and more particularly relates to devices for use as an independent apparatus, or in conjunction with a drafting machine as an adjunct to the drafting machine, which permits the development of perspective views in such a manner that the horizon and horizontal angle of view can be selected, or alternatively stated, that the angle of view with regard to vertical and horizontal rotations of the object can be selected.

Briefly, the invention comprises in one form a pair of straight edges pivotally connected to a centerpiece, which centerpiece is removably fixable to the horizontal arm of a drafting machine in place of the horizontal scale so that the adjunct device will move in certain ways as the drafting machine knob is manipulated. Each of the straight edges is provided with a vanishing point guide within which the associated straight edge is slidable. Each of the vanishing point guides is provided with a pin on its bottom surface extending substantially orthogonally to the drafting table, and which pins are projectable downwardly for pivotal seating movement within a selected one of a number of holes which are provided in the surface of the drafting table. The portions of the drafting board which contain these holes may be provided initially as an integral part of a substantially larger drafting board unit, or may be independent pieces which are securable to the drafting board on the left and the right sides of the board for use with the perspective drafting device.

The holes into which the vanishing point guides are pivotally projected are provided in a pattern which includes a series of horizontally spaced holes symmetrically located at the left and right sides of the table for use by each of the straight edges, and also in rows of such holes spaced vertically along the drafting board. The vertical spacing of the holes is used to select the particular horizon desired, whereas the horizontal spacing of the holes provides horizontal rotation of the perspective view as desired. Any number of holes may be provided in a given horizontal line depending upon the number of different horizontal rotations that might be desirable, and a number of rows of such holes spaced vertically can be provided in accordance with the number of different horizons that are desired. With a relatively small number of holes, as for exmaple 3 or 4, in a horizontal line, substantially 95% of the desirable horizontal rotations are available. However, it is possible to make an infinitely variable arangement in which the vanishing point guides are slidable in a vertical slot instead of having a plurality of rows of holes, and the guides being provided with a separate horizontally slidable element which will in effect provide infinite variation in horizontal line, so that any desired combination can be achieved. In practice, it is probably not necessary a provide this combination since a reasonable number of indexed holes will provide all that is generally needed or desired.

The centerpiece of the perspective device to which the straight edges are affixed, and which itself is removably attached to the horizontal arm of the drafting machine, is provided with a hole through which a vertical pin extending upward from the bottom edge of the table may be disposed. This hole is positioned in the centerpiece so that the center of the hole is in vertical alignment with the right-hand edge of the vertical scale of the drafting machine. Alternatively, or additionally, a hole can be provided in the plate such that the center of the hole is in vertical alignment with the left-hand edge of the vertical scale of the drafting machine. When the hole in the centerpiece is projected onto the fixed pin, the pin acts as a pivot so that movement of the drafting machine control knob permits pivoting rotation of the vertical scale to the left and to the right so that lines may be established from significant parts of the drafting from which it is desired to make the perspective view. The fixed pin is selectively movable for positioning in any one of a series of holes extending at spaced intervals along the lower edge of the drafting table which correspond to the horizontal rotations associated with the holes in the horizontal rows for use with the vanishing point guide.

The known prior art includes perspective drawing devices which include two lateral straight edges to provide different horizons. However, none of the prior art discloses or suggests the structure of the invention or any equivalent thereto which produces the result achieved by the hole in the centerpiece which is projected onto the fixed pivot in the board to permit angular rotation of the drafting machine vertical scale. Without the ability to do this, it is impossible, except by chance, to develop true and correct angles of view. Additionally, none of the prior art discloses or suggests the structure of the invention which achieves the variable horizontal angle of view provided by the series of vanishing point guides holes extending horizontally in any given row and along the lower edge of the drafting table. Accordingly, a primary object of the invention is to provide a novel perspective drafting apparatus which includes the ability to rotate the vertical scale of a drafting machine in coordinated conjunction with movement of the straight edges which provide selected variable horizontal angles of view.

Another object of the invention is to provide a novel perspective drafting apparatus which in one form comprises an attachment to the horizontal arm of a standard drafting machine in place of the horizontal scale, and which in another form is a modification of a standard cable controlled parallel shiftable drafting table vertical straight edge.

A further object of the invention is to provide a novel perspective drafting apparatus as aforesaid which permits the development of accurate perspective views showing selectable vertical and horizontal rotations of the object being drawn.

Still another object of the invention is to provide a novel perspective drafting apparatus as aforesaid which accomplishes the desired result by utilizing a shiftable vertical straight edge and a pair of shiftable horizontal straight edges in conjunction with selectable means which accurately control the positions of the straight edges in any given selected mode for developing a selected horizontal angle of rotation and horizon.

The foregoing and other objects of the invention will be better understood from a reading of the following specification in conjunction with an examination of the appended drawings, wherein:

FIG. 3 is a vertical cross-section through the right straight edge and vanishing point guide at the pivot pin as would be seen when viewed along the line 3—3 on FIG. 1;

FIG. 7 is a cross-section as would be seen when viewed along the line 7—7 on FIG. 5;

FIG. 8 is a cross-section as would be seen when viewed along the line 8—8 on FIG. 5;

FIG. 9 is a cross-section as would be seen when viewed along the line 9—9 on FIG. 5;

FIG. 10 is a cross-section as would be seen when viewed along the line 10—10 on FIG. 5.

In the several figures, like elements are denoted by like reference characters.

Figure 1:
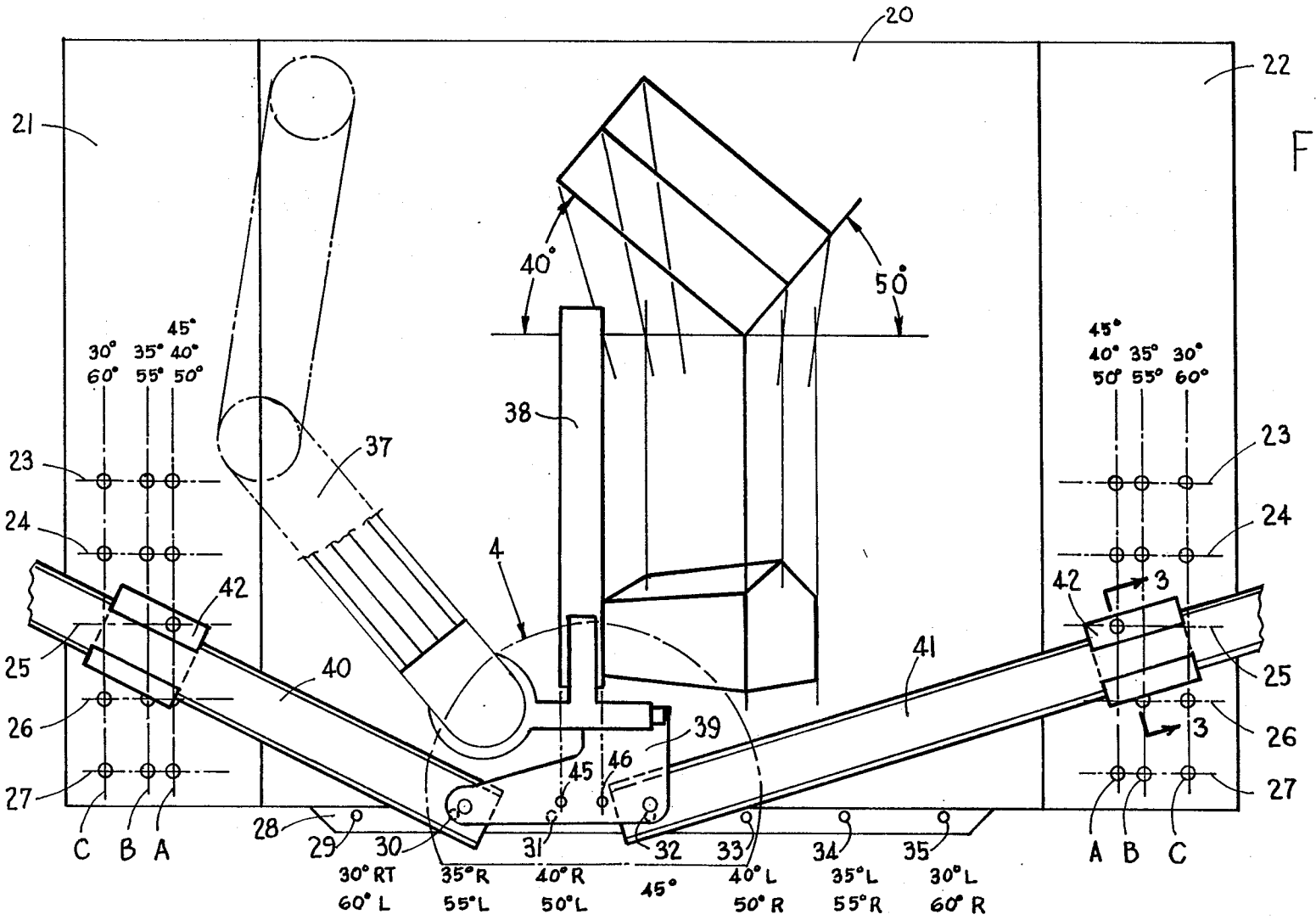
FIG. 1 is a plan view of the novel drafting apparatus according to the invention attached to a drafting machine, and showing the portions comprising modifications to a drafting table, and with the drafting machine locked to maintain the vertical scale in its vertical orientation.

Considering first FIGS. 1 through 4 which show one embodiment of the invention, there is seen a drafting board designated generally as 20 having affixed respectively to the left and right side edges thereof wing pieces 21 and 22 through each of which are formed vertically spaced rows of holes designated in each wing piece as 23 through 27, each pair of left and right rows having the same number corresponding to the selection of a particular horizon line for a perspective drawing. The left and right pair of horizon rows numbered 25 are used when a 0° horizon is desired, the pair of horizon row holes 24 being used when a 30° down viewing angle is desired, whereas the horizon row holes 23 are employed when a downward view of 60° is desired. Similarly, the horizon row holes 26 are utilized when an upward view of 30° is desired, whereas the horizon row holes 27 are used when an upward view of 60° is desired. As shown in FIG. 1, a 0° horizon has been illustrated.

Each of the horizon rows 23 through 27 includes three horizontally spaced holes designated generally for each row as A, B and C, such designations being shown on right side row 23 and on left side row 24. The vertical row of holes designated as A correspond to a horizontal rotation of the object to be shown in perspective by which the object will appear to be viewed from an angle of 40° on one side and 50° on the other side, whether right side or left side is determined by a part of the apparatus not yet described. The same set of vertical holes A is also usable for a 45° view since the differences in positional shift of such holes would be very slight and not really noticeable. Similarly, the vertical rows of holes B correspond to a horizontal view rotated 35° in one direction and 55° in the other direction, whether to left or right again being determined as will be hereinafter described. Finally, the vertical rows of holes C correspond to a horizontal view angle of 30° in one direction and 60° in the other direction.

Figure 4:
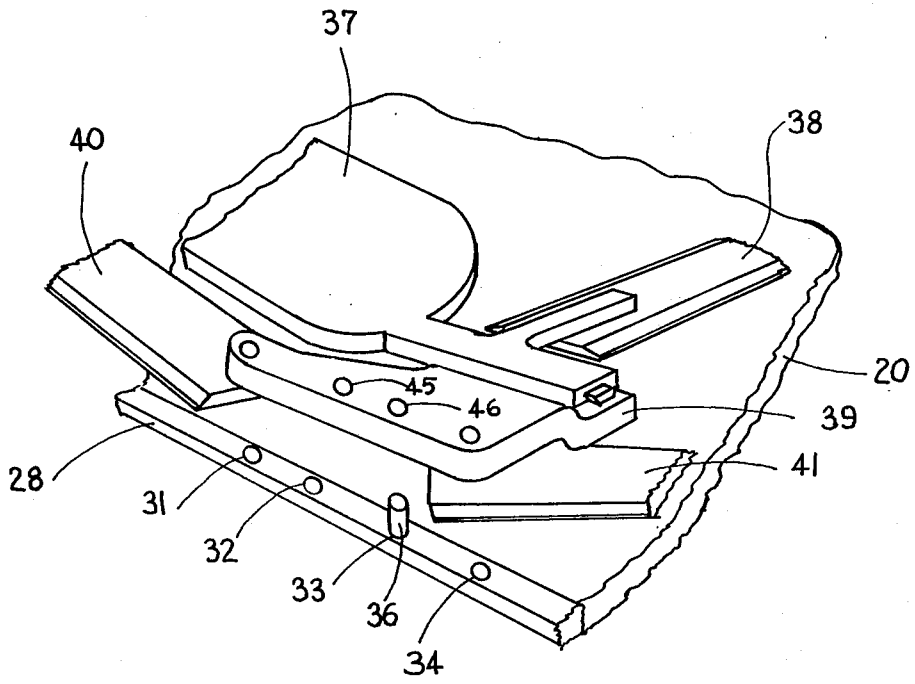
FIG. 4 is a partial perspective view of the portion of the apparatus shown in the phantom circle on FIG. 1, more clearly showing the centerpiece pivot pin.

Affixed to the lower edge of the drafting board 20 is a horizontal rotation control pin board 28 through which are formed seven control pin receiving holes 29 through 35, into one of which holes is placed a control pin which corresponds to a desired horizontal view. For example, if a 45° left and right view is desired, the control pin would be placed in the hole 32. Similarly, if a horizontal view showing 35° to the right and 55° to the left were desired, the control pin would be placed in the hole 30, and so on. The control pin holes 29 through 35 are used in conjunction with the vertical columns A, B and C of the horizon row holes. For example, if either a 45° horizontal view or a 40°/50° left or right view is desired, the holes A in the horizon rows will be used in conjunction with a selected one of the control pin holes 31, 32 or 33. If either of the 35°/55° control pin holes 30 and 34 is used, it will be used in conjunction with the vertical row of holes B in the horizon rows. If a horizontal view of 30°/60° is selected by selection of either of the control pin holes 29 or 35, then the vertical row holes C will be selected in the particular horizon row. The control pin designated as 36 is best seen in the showing of FIG. 4.

Figure 2:
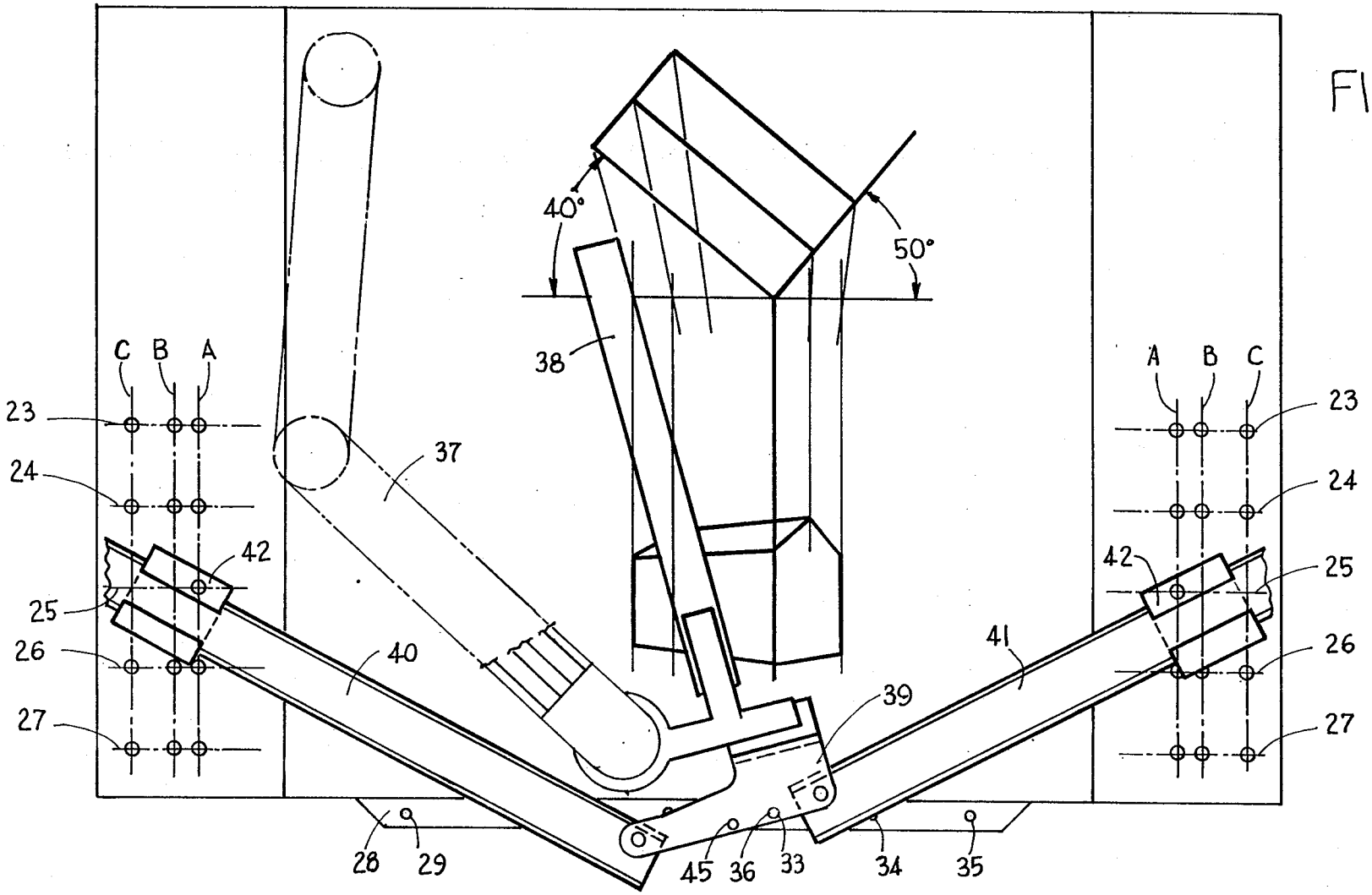
FIG. 2 is a view similar to FIG. 1 but with the drafting machine unlocked to allow rotation of the vertical scale about the pivot pin projected through the centerpiece of the apparatus.

As best seen in FIGS. 1 and 2, a standard drafting machine designated generally as 37 is secured to the upper left corner of drafting board 20 in its normal and usual fashion and includes the standard vertical scale 38. However, the normal horizontal scale has been removed, and in its place on the horizontal arm of the drafting machine is removably fitted a centerpiece 39 of the novel drafting apparatus according to the invention. Pivotally secured to the centerpiece 39 at the left and right sides thereof are a pair of straight edges 40 and 41 each of which is slidably projected through a vanishing point guide 42. Each of the vanishing point guides 42 is provided with a pin 43 projecting downward from its bottom surface extending substantially as best seen in FIG. 3. The vanishing point guide pins 43 are fixable in the selected hole by means of wing nuts 44 removably securable to their lower ends. As also best seen in the showing of FIG. 3, the center line of the vanishing point guide pin 43 is aligned with the upper edge of the corresponding straight edges 40 and 41.

The centerpiece 39 is also provided with a pair of control pin holes 45 and 46, the center of the hole 45 being in alignment with the left edge of the vertical scale 38 of the drafting machine, while the center of the right control pin hole 46 is in alignment with the right hand edge of the vertical scale 38. The control pin hole which is selected for use is determined by whether the left hand edge or the right hand edge of the vertical scale is selected as the drawing edge. In the illustrated case, as shown in FIG. 2, the control pin hole 46 has been selected through which the control pin 36 is projected for drawing the perspective illustrated in the drawings. The manner of utilization of the apparatus just described in FIGS. 1 through 4 will be further described in conjunction with the description of FIG. 11, but before considering FIG. 11, attention should be turned to FIGS. 5 through 10 which illustrate a second embodiment of the apparatus, both embodiments being usable in the manner to be described in connection with FIG. 11.

Figure 5:
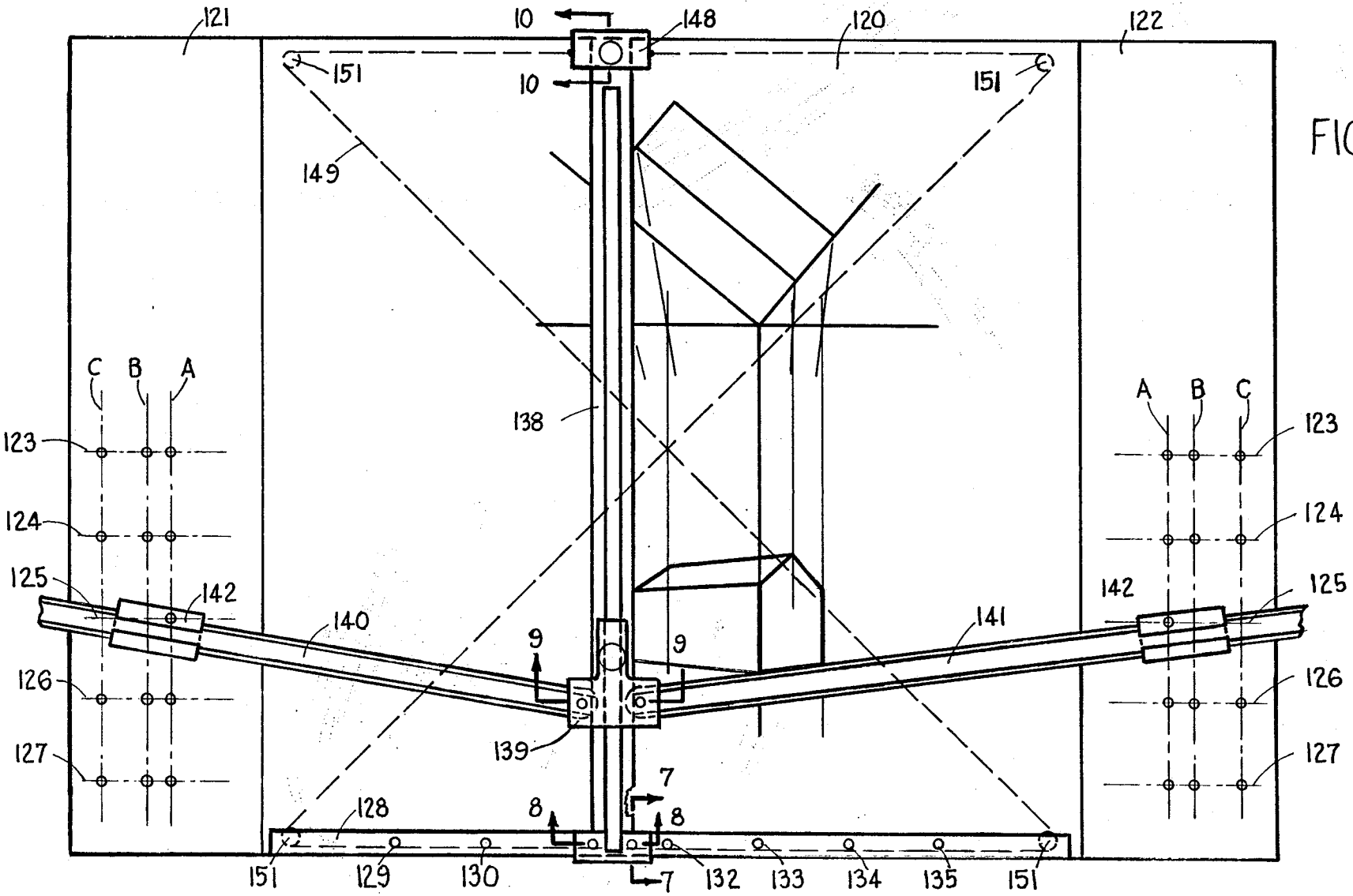
FIG. 5 is a plan view of a second embodiment of the invention as applied to a cable controlled parallel shiftable drafting table vertical straight edge.

Considering first FIG. 5, there are seen basically all of the elements previously designated in the showing of FIGS. 1 through 4 except that the corresponding parts in FIG. 5 are preceded by the number 1, so that for example the drafting board 20 of FIG. 1 is designated as 120 in FIG. 5, the straight edges 40 and 41 of FIG. 1 are designated as 140 and 141, and so on. There are however, some differences between the structures, which will now be described. As a first matter, the centerpiece 139 in FIG. 5 is not exactly like the centerpiece 39 in FIG. 1 because it does not contain the control pin holes, these control pin holes in the structure of FIG. 5 being designated as 145 and 146 and being located in a bottom slider 147 to which the lower end of the vertical scale 138 is affixed. The upper end of the vertical scale 138 is also releasably affixed to a top slider 148. The top slider 148 and bottom slider 147 are fixed to a continuously running cable 149 by means of clips 159, best seen in the showings of FIGS. 8 and 10. The cable 149 is trained about four corner pulleys 151 in a cross-over configuration so that the top and bottom sliders are slidable with parallel synchronous movement to permit the vertical scale 138 to be shifted left and right in constant vertical orientation. The fact that the centerpiece 139 could not be moved vertically if it were fixed to the bottom slider 147, with comparable movements to the drafting machine 37 shown in FIG. 1, requires that the centerpiece 139 be slidably movable on the vertical scale 138, this being shown most clearly in FIG. 9.

The pivoting movements of the vertical scale 38 in the apparatus of FIG. 1 which are controlled by the control pin holes 45 and 46 and the control pin 36 are accomplished by the corresponding control pin structure shown most clearly in FIGS. 2 and 4. In order to effect the pivoting movement of the vertical scale 138, however, the upper end of the vertical scale must be released from the top slider 148, and this structure is best seen in the showing of FIG. 10. As best seen in FIG. 10, the upper end of the vertical scale 138 is releasably positioned within the top slider 148 and held captive therein by the threaded pin 152. To release the vertical scale 138, the pin 152 is rotated counterclockwise to rise above the upper surface of vertical scale 138 so that the vertical scale tip may be moved out of the top slider 148.

The control pin structure for controlling pivoting movement of the lower end of the vertical scale 138 is shown in FIGS. 7 and 8, to which reference should now be made. The bottom slider 147 is generally of U-shaped configuration and wraps around the lower edge of the drafting board 120 and overlies a metal plate 153 which defines the upper surface of the horizontal rotation pin board 128, and is utilized to prevent wear of the holes in the drafting board. Disposed on top of the upper surface of the bottom slider 147 is a low friction washer 154 which may be made of some suitable material, such as a plastic. Securable to the bottom slider 147 is a control pin assembly which includes a cylindrical sleeve 155 downward through which is projected a spring-loaded control pin 156 biased upward normally by a spring 157. The cylindrical sleeve 155 is configured as shown in FIGS. 7 and 8 so that a horizontally extending guide pin 158 can rise vertically upward or be locked at a lower position in a generally L-shaped control slot 159 formed in the cylindrical sleeve 155.

Figure 6:
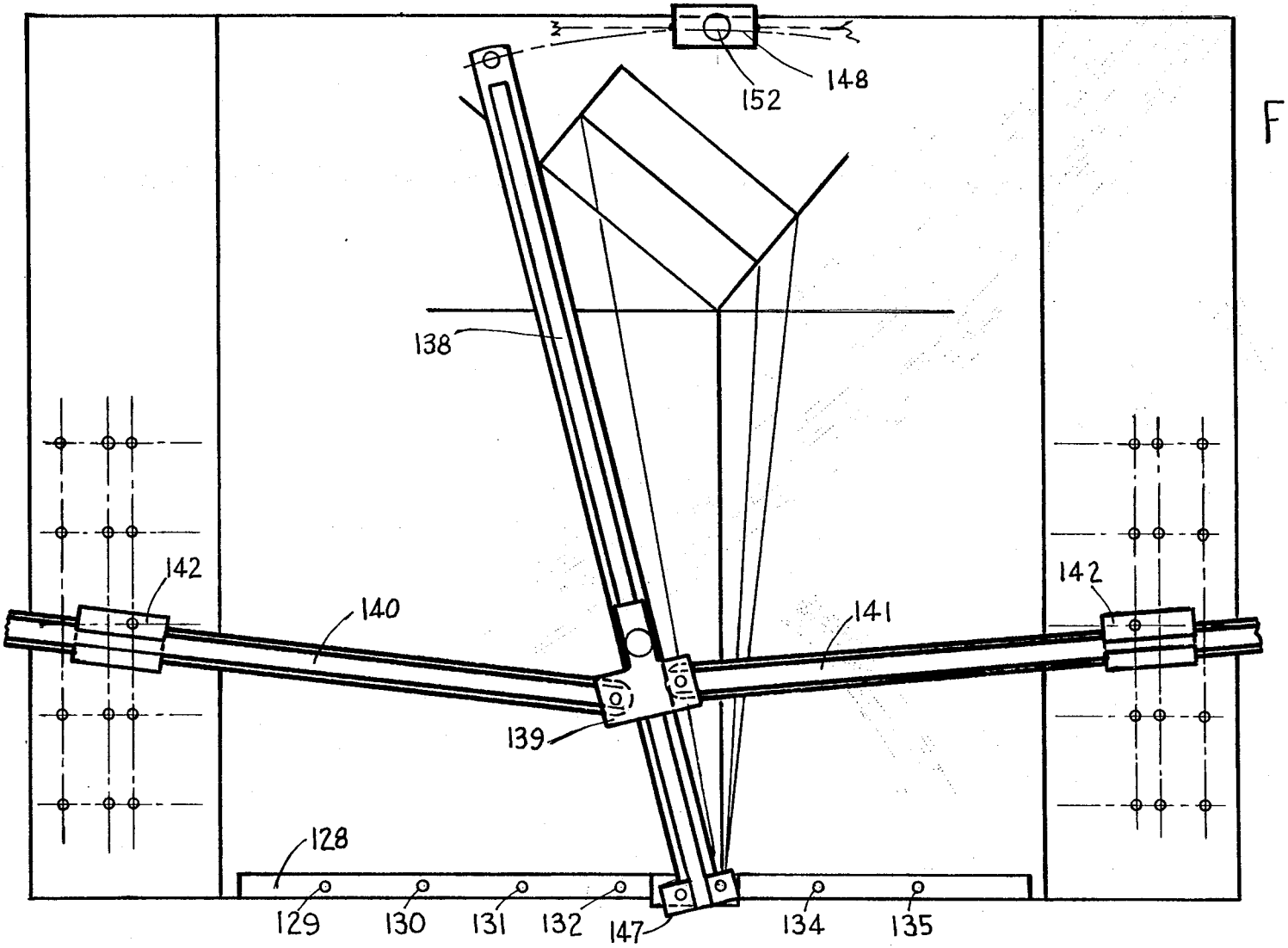
FIG. 6 is a view of the apparatus of FIG. 5 with the upper end unlocked to permit pivoting rotation of the straight edge.

When the guide pin 158 is disposed in the upper end of the control slot 159 as shown in FIG. 8, the control pin 156 is biased upward so that its bottom end does not project into any of the control pin holes formed in the drafting board 120 and the metal plate 153. In this condition the bottom slider 147 is not fixed to the pin board 128 and is laterally slidable as in the organization shown in FIG. 5. However, when the control pin 156 is depressed against the spring pressure and rotated so that the guide pin 158 moves into the horizontal run of the control slot 159, the lower end of the control pin 156 is projected downward and held in the selected control pin hole of the pin board 128, as shown in FIG. 6. The method of utilizing the apparatus according to the invention in either of its illustrated embodiments is shown in FIG. 11, to which attention should be now directed.

Figure 11:
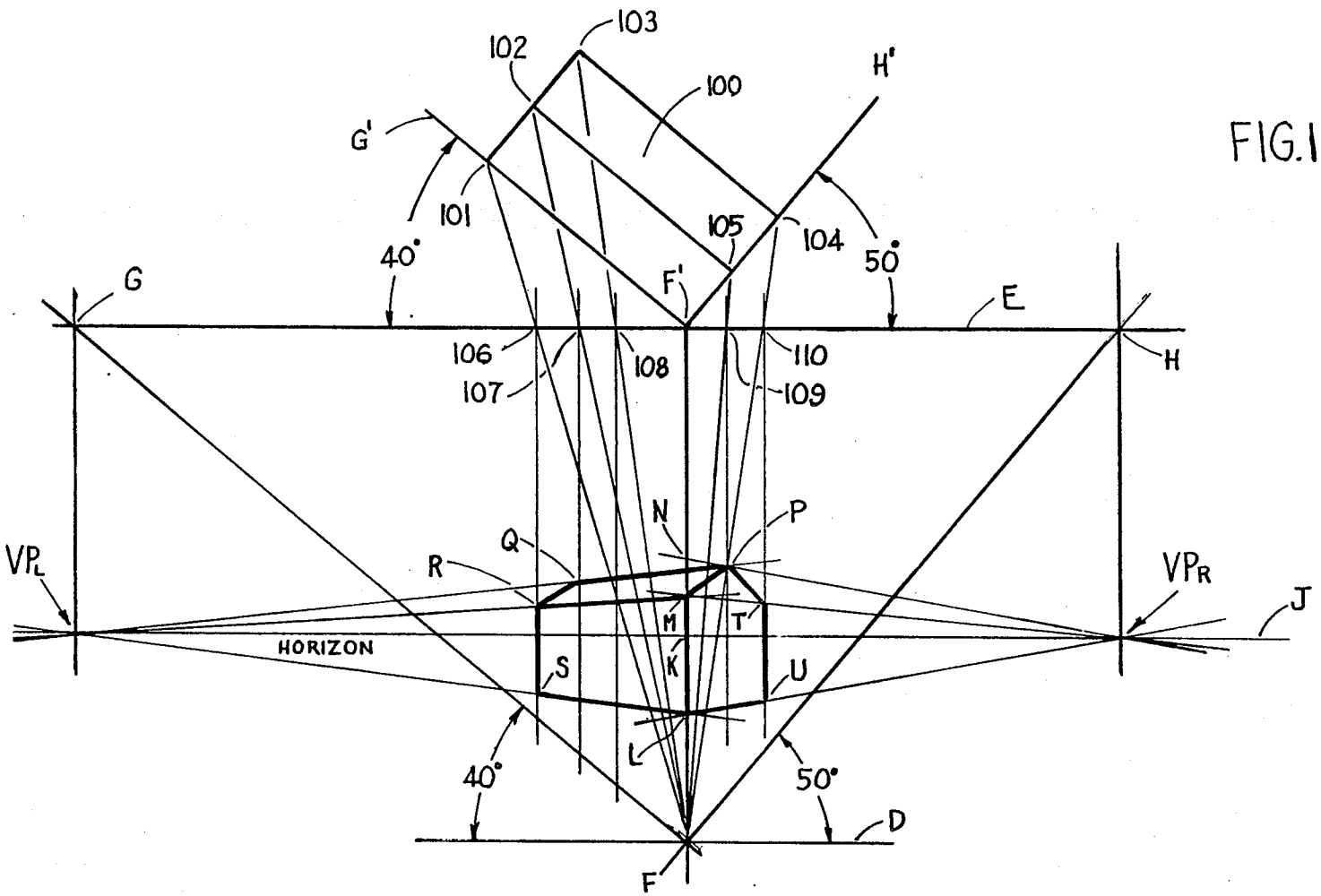
FIG. 11 illustrates the use of the apparatus according to the invention to develop a 40°/50° horizontal viewing angle drawing with a zero degree horizon.

Assume that FIG. 11 initially is blank, and that the following constructs are made in order. First, draw lower line D and upper line E representing the usual visual distance when looking at a book, as for example from a distance of approximately 18". Erect a perpendicular in approximately the center of the drawing area between the two lines D and E and designate the lower and upper intersections respectively as F and F'. Select a horizontal viewing angle for the perspective view to be drawn, for example in this instance a 40°/50° view, and from point F extend lines upward at the selected angles to intersect line E respectively at points G and H. Draw lines parallel to FG and FH from the point F' so that the lines resulting are F'G' and F'H'.

Place a plan view of the item to be drawn in perspective, as for example the plan view of a barn designated as 100 as shown on FIG. 11, where the sides of the plan view are as close to lines F'G' and F'H' as possible. Number the significant points 101 through 105 as shown, and draw construction lines from each of these points 101 through 105 toward the point F so that they at least intersect the line E. Additionally, similar lines should be drawn toward the point F from significant points on the unseen lower levels of the structure, such additional lines not being shown in the illustration. The intersection of these construction lines with line E have been indicated as the points 106 through 110. From each of these intersections drop vertical construction lines down through the drawing area and understand that each of these vertical lines is also identified by the point number at its upper end, that is, 106 through 110.

Select a horizon line on the drawing area in accordance with the desired point of view, that is, from above, from below or from a 0° horizon. In the illustrated case in FIG. 11 a 0° horizon has been selected with the horizon line being designated as J. In the illustrated case the horizon line is approximately five feet from the bottom of the barn like structure to be drawn since this is substantially eye height. From the points G and H drop vertical lines to intersect the horizon line J, these intersects being on the left the vanishing point $VP_L$, and on the right the vanishing point $VP_R$.

From the intersection of the horizon J with line FF', designated as point K, measure down five feet to point L to the same scale that the plane of the barn 100 is drawn. From point L measure up along line FF' the height of the corner of the barn to point M, and solidify this line segment. Again from point L measure up the overall height of the barn and mark this as point N on line FF'. Extend a line from $VP_R$ to point N and mark the intersection of this line with the vertical line 109 as point P, which corresponds in the perspective developed view to the peak of the roof.

From this point P a solid line is drawn to point M, and this line segment can also be drawn in solidly. From point $VP_L$ extend a line to point P and mark point Q at vertical line 107; from point $VP_L$ extend a line to point M and mark point R at vertical line 106; and from point $VP_L$ extend a line to point L and mark point S at the intersection with line 106. Connect and heavy the line segments between points R and S, between points R and Q, between points R and M, Q and P and between points S and L. From right hand vanishing point $VP_R$ extend a line through point M and mark point T at the intersection with vertical line 110; and from point $VP_R$ extend a line through point L and mark point U at the intersection with vertical line 110. Connect the line segments between the points P and T, the points L and U, and the points U and T. This completes the perspective 40°/50° view of the visible part of the barn.

Having now described my invention in connection with particularly illustrated embodiments thereof, it will be understood that modifications and variations of the invention may now naturally occur to those persons normally skilled in the art without departing from the essential scope and spirit of the invention, and accordingly it is intended to claim the invention broadly as well as specifically as indicated by the appended claims.

What is claimed to be new and useful is:

1. For use with a drafting apparatus for developing accurate perspective views from plan views of objects, wherein the drafting apparatus is of the type including a normally rectangular drafting board having upper and lower edges and left and right side edges, and a drafting machine movably affixed to the drafting board, the drafting machine having a vertical scale and a pair of left and right straight edges extending laterally in opposite directions from the vertical scale, the improvement comprising, (a) a pair of left and right vanishing point guides within which each of the left and right straight edges is respectively slidable, (b) left and right vanishing point guides positioning means for coupling said left and right vanishing point guides to the drafting board respectively at the left and right marginal areas thereof for pivoting movement with respect to the latter in a plane parallel to the plane of the drafting board upper surface and about left and right axes orthogonal to said plane, said left and right vanishing point guides positioning means comprising first positioning means for respectively fixing said left and right pivoting movement coupling axes of said vanishing point guides at at least one left and one right selectable point along at least a first line extending parallel to the lower edge of the drafting board, and (c) first and second selectably coactable drafting machine vertical scale angular control means, said first vertical scale angular control means being fixedly positioned with respect to said vertical scale, and said second vertical scale angular control means including locating means for fixedly positioning said second angular control means at at least one point on a second line parallel to the lower edge of the drafting board, said vertical scale being fixed for pivoting movement in a plane parallel to the plane of the drafting board upper surface about an axis orthogonal to said plane when said first and second coactable angular control means are coactably associated.

2. Apparatus as set forth in claim 1 wherein said left and right vanishing point guides positioning means each comprises second positioning means for fixing said left and right pivoting movement coupling axes at selectable points along a pair of parallel lines located respectively at the left and right sides of the drafting board and orthogonal to the said second line extending parallel to the lower edge of the drafting board.

3. Apparatus as set forth in claim 1 wherein said vanishing point guides first positioning means includes means for respectively fixing said left and right pivoting movement coupling axes of said vanishing point guides at a plurality of left and right selectable points along said at least a first line extending parallel to the lower edge of the drafting board.

4. Apparatus as set forth in claim 1 wherein said vanishing point guides first positioning means includes means for respectively fixing said left and right pivoting movement coupling axes of said vanishing point guides at a plurality of left and right selectable points along said at least a first line extending parallel to the lower edge of the drafting board, the spacing between a pair of adjacent points of said plurality of left selectable points being the same as the spacing between a correspondingly positioned pair of adjacent points of said plurality of right selectable points.

5. Apparatus as set forth in claim 4 wherein said second vertical scale angular control means locating means comprises means for selectably fixedly positioning said second angular control means at one of a plurality of points along said second line extending parallel to the lower edge of the drafting board, whereby different selected horizontal angles of view in a developed perspective may be repeatably obtained.

6. Apparatus as set forth in claim 5 wherein for each one of said plurality of points of said locating means for selectably positioning said second vertical scale angular control means there is a corresponding pair of left and right vanishing point guides first positioning means.

7. Apparatus as set forth in claim 1 wherein said second vertical scale angular control means locating means comprises means for selectably fixedly positioning said second angular control means at one of a plurality of points along said second line extending parallel to the lower edge of the drafting board.

8. Apparatus as set forth in claim 1 further including means for unlocking the vertical scale from a locked vertical position so that it is free to assume angles that are non-parallel and non-orthogonal to the edges of the drafting board.

9. Apparatus as set forth in claim 1 wherein said first vertical scale angular control means comprises a pivot hole the center of which lies on the line which defines one drawing edge of the vertical scale, and wherein said second vertical scale angular control means comprises a pivot pin projectable through said pivot hole and about which pin said vertical scale is angularly swingable.

10. Apparatus as set forth in claim 1 wherein said vanishing point guides first positioning means includes means for respectively fixing said left and right pivoting movement coupling axes of said vanishing point guides at a plurality of left and right selectable points along said at least a first line extending parallel to the lower edge of the drafting board and also along each of a plurality of parallel spaced apart lines all of which also extend parallel to the lower edge of the drafting board, the spacing between a pair of adjacent points of said plurality of left selectable points being the same as the spacing between a correspondingly positioned pair of adjacent points of said plurality of right selectable points, and wherein the said first positioning means in each of said plurality of parallel spaced apart lines lie on parallel lines orthogonal to said second line extending parallel to the lower edge of the drafting board.

11. Apparatus as set forth in claim 10 wherein said second vertical scale angular control means locating means comprises means for selectably fixedly positioning said second angular control means at one of a plurality of points along said second line extending parallel to the lower edge of the drafting board, whereby different selected horizontal angles of view in a developed perspective may be repeatably obtained.

* * * * *